United States Patent [19]

Ferro

[11] 3,949,754

[45] Apr. 13, 1976

[54] SELF-PIERCING EAR WIRE

[75] Inventor: Nicholas J. Ferro, Johnston, R.I.

[73] Assignee: Ferro Novelty Company, Inc., Johnston, R.I.

[22] Filed: Sept. 11, 1974

[21] Appl. No.: 504,900

[52] U.S. Cl. ..... 128/330
[51] Int. Cl.[2] ..... A61B 17/34
[58] Field of Search ..... 63/12; 128/330, 329

[56] References Cited

UNITED STATES PATENTS

| | | | |
|---|---|---|---|
| 511,952 | 1/1894 | Hubash | 128/330 |
| 3,345,830 | 10/1967 | Fontaine | 128/330 X |
| 3,760,604 | 9/1973 | DiStefano | 128/330 X |

FOREIGN PATENTS OR APPLICATIONS

| | | | |
|---|---|---|---|
| 1,206,595 | 9/1970 | United Kingdom | 63/12 |
| 525,986 | 5/1955 | Italy | 128/330 |

*Primary Examiner*—Channing L. Pace
*Attorney, Agent, or Firm*—Barlow & Barlow

[57] ABSTRACT

A self-piercing ear wire formed as a substantially circular loop having a sharp tapered point at each end thereof with one of the ends receiving a pressure pad in sliding engagement therewith. The ear wire is preferably made from a non-corrosive material such as gold and is spring tempered so that it will normally have the two points thereof passing by each other when the ear wire is placed on the ear lobe with the two pointed ends extending in from opposite sides thereof. The pressure pad can be slid along the ear wire to locate the same properly on the ear lobe with each point of the ear wire engaging the skin at each side of the ear lobe.

3 Claims, 3 Drawing Figures

SELF-PIERCING EAR WIRE

SUMMARY OF THE INVENTION

According to the present invention, which relates generally to the jewelry art, there is provided a self-piercing ear wire that is so designed and arranged as to be placeable on a wearer's ear lobe after which the wire will slowly and automatically penetrate the ear lobe until it is completely pierced. The ear wire is made from spring tempered, non-corroding wire and has a tapered point at each end thereof and slidably engaged about the ear wire is a pad which may slip along the ear wire and once the wire has been placed about the ear lobe at proper location, the pad may be moved up to engage the ear lobe and thereby hold the piercing wire in the proper position so that one pointed end willl pass directly towards the other pointed end and provide a clean hole through the ear lobe, as the pointed end steadily pierces the wearer's lobe.

BACKGROUND OF THE INVENTION

It has heretofore been proposed to provide self-piercing earrings with a pair of pointed elements spring biased towards each other. This is known conventionally as the "sleeper" or self-piercing ear wire, but when it is placed on an ear lobe or for that matter anything else, it tends to twist so that one pointed end will not pass directly towards the other pointed end, or if it does substantially pass towards the other pointed end, the hole will not be made straight through the ear lobe but rather at an angle thereto. It is, therefore, one of the principal objects of the present invention to avoid incorrectly pierced holes and to place a device on the ear wire in such a way that the two pointed ends will pass directly towards each other. Some of the prior art approaches to this arrangement are well illustrated in such patents as Handerson U.S. Pat. No. 2,713,863 where a pointed end is directed towards an aperture and another end of an open earring. In Norgaard, U.S. Pat. No. 2,869,338, an enlargement or lobe plate is provided against which a pointed end is directed. However, this differs from the instant invention in the fact that the instant invention has two pointed ends, each of which engage the ear lobe on opposite sides thereof.

DESCRIPTION OF THE PREFERRED EMBODIMENT

Figure 2:
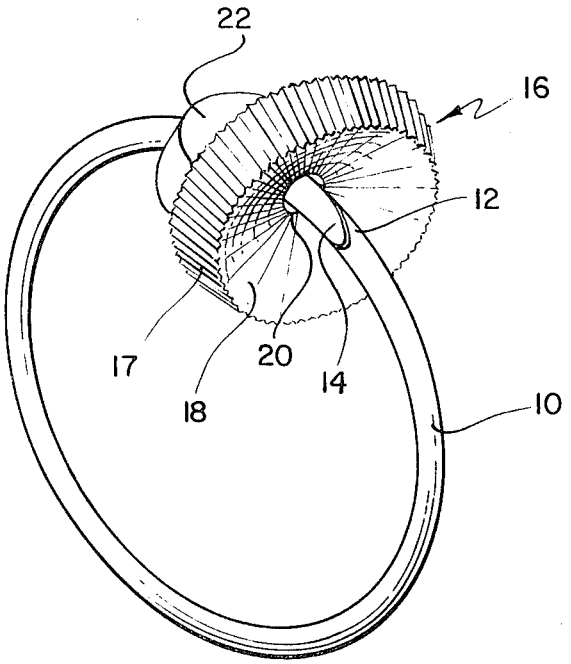
FIG. 2 is a perspective view in enlarged form of the applicant's invention with the lobe pad attached.
Figure 1:
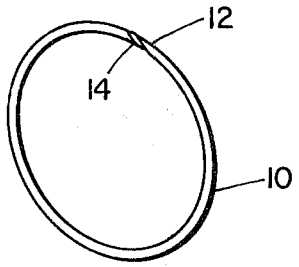
FIG. 1 is a perspective view of an ear wire without the pad attached thereto.

Referring now to the drawings, and more particularly to FIG. 2 thereof, there is shown at 10 an ear wire comprising a complete but discontinuous wire loop made from spring tempered wire of a non-corrosive type. Each end of the loop is provided with a tapered sharp point 12 and 14, respectively. It is important to note, as seen in FIGS. 1 and 2, that the tapered points

12 and 14 normally lie just slightly in overlapping relationship as in a chisel point arrangement.

On and about the ear wire 10 a pressure pad locator generally designated 16 is provided. This locator is substantially circular in shape and may have an outwardly gripping surface as indicated at 17 with a concave face 18. Through the center of this locator piece, there is an aperture 20 through which the ear wire 10 passes. The complete body of the pressure pad locator can be made in a number of configurations and, as shown, has extending away from the concave face 18, as is viewed in FIG. 2, a further body portion 22 through which the ear wire passes. Preferably the pressure pad locator 16 is made of a plastic material and may be made of one of the plastic materials which have a sliding and yet gripping action on metallic parts as, for example, polyethylene which exhibits such a characteristic as does PTFE and a number of other plastics. To this end, the hole 20 should be sized so that proper gripping around the ear wire is had as well as enabling the same to be slid therealong.

Figure 3:
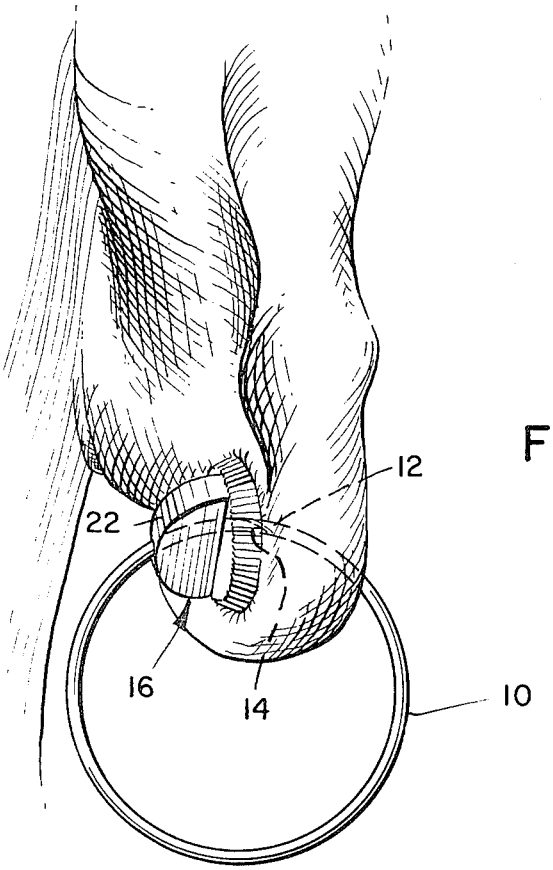
FIG. 3 is an illustrative view in elevation showing applicant's device in operation on an ear lobe.

In operation, the wire loop 10 is spread apart so that the pointed ends 12 and 14 are sufficiently spread from each other to enable the ends to be placed about a wearer's ear lobe. The sharp pointed ends 12 and 14 are then located at the desired spot on the ear lobe, and the pressure pad locator 16 is slid along the wire until it engages the rear side of the ear lobe as shown in FIG. 3. When the parts have been positioned, it will be apparent that the pointed end 14 engages the rear side of the ear lobe, while the pointed end 12 engages the outward side of the ear lobe, and the pressure of the tempered wire will gradually allow the pointed end 12 to approach the pointed end 14. Usually after two or three days, the wire will complete its penetration through the wearer's lobe as seen in FIG. 3, at which time the two pointed ends will assume a slight overlapping relationship as they were in the unstressed relationship as shown in FIG. 1, the chisel ends overlapping each other and terminating within the concave face of the locator 16.

What is claimed is:

1. A self-piercing ear wire consisting of a circular discontinuous loop of non-corrosive tempered spring wire having tapered pointed ends in overlapping engagement, a pressure pad locator comprising a dished plate having an axial bore passing therethrough and slidingly engaging the ear wire and being slidable along the ear wire toward and from one of the pointed ends thereof and having its dished portion of enlarged section whereby the locator may be positioned adjacent the overlapped ends and the ends may be spread apart to place the wire in tension with the pointed ends engaging an ear lobe, and the locator thereafter slid against the lobe to position said bore and the portion of the wire passing therethrough with their axes normal to the ear lobe.

2. An ear wire as in claim 1 wherein the ends of the wire are tapered to a chisel point to normally overlie each other.

3. An ear wire as in claim 2 wherein the pressure pad locator has a concave face normal to the wire and facing an end thereof in which the overlapping ends may be located.

* * * * *